United States Patent [19]

Kleber

[11] Patent Number: 4,833,762

[45] Date of Patent: May 30, 1989

[54] DEVICE FOR THE PRODUCTION OF CRUMPLE PLEAT CREASE PATTERNS IN FABRIC WEBS

[76] Inventor: Kurt Kleber, Zum Mühlgraben 4, D-6842 Bürstadt, Fed. Rep. of Germany

[21] Appl. No.: 139,475

[22] Filed: Dec. 30, 1987

[51] Int. Cl.[4] ..... D06C 23/04

[52] U.S. Cl. ..... 26/69 R; 26/1; 26/2 R; 28/155; 28/160; 28/163; 223/28

[58] Field of Search ..... 26/1, 26 R, 69 R; 28/160, 163, 249, 267, 281, 155; 223/28

[56] References Cited

U.S. PATENT DOCUMENTS

| | | | |
|---|---|---|---|
| 3,380,132 | 4/1968 | McKew | 28/249 |
| 3,526,024 | 9/1970 | Fay | 28/281 |
| 3,831,233 | 8/1974 | Rendall et al. | 28/281 |
| 3,866,279 | 2/1975 | Kennedy | 28/281 |
| 3,987,519 | 10/1976 | Potosnak et al. | 26/1 X |
| 4,134,187 | 1/1979 | Damon, Sr. | 26/2 R |
| 4,407,052 | 10/1983 | Kuhn | 26/2 R |

FOREIGN PATENT DOCUMENTS

| | | | |
|---|---|---|---|
| 0158777 | 10/1985 | European Pat. Off. | 223/28 |
| 2932495 | 2/1981 | Fed. Rep. of Germany | 26/2 R |
| 1452774 | 7/1965 | France | 28/267 |
| 0232321 | 1/1986 | German Democratic Rep. | 26/2 R |
| 0240571 | 11/1986 | German Democratic Rep. | 26/1 |

*Primary Examiner*—Robert R. Mackey

[57] ABSTRACT

An apparatus for producing permanently set crumple pleat crease patterns in fabric webs, having a heatable crumple tube with an oscillatingly driveable stuffing element with which a fabric web in rope form is batchwise successively inserted into the crumple tube, compressed and finally forced out. Upstream of the entry end of the crumple tube there is a rope feed tube of smaller diameter than the crumple tube. The rope feed tube has a through-hole connected on the outside to a vacuum source, while part of the crumple tube is concentrically surrounded by a jacket tube. Annular gaps between the crumple and jacket tubes are tightly sealed by annular walls, thereby forming a heating chamber with an inlet and an outlet for a fluid heating medium. In the heating chamber there are an electric resistance heating element, a temperature sensor and a pressure sensor for determining the temperature and pressure respectively of the fluid fed into the heating chamber, and a control circuit for continuously processing temperature and pressure proportional signals developed by the sensors to control connection and interruption between an electric power supply and the resistance heating element.

18 Claims, 2 Drawing Sheets

DEVICE FOR THE PRODUCTION OF CRUMPLE PLEAT CREASE PATTERNS IN FABRIC WEBS

BACKGROUND OF THE INVENTION

The invention relates to a device for producing permanently set crumple pleat crease patterns in fabric webs using a heatable crumple tube at one end of which there is provided an oscillatingly driveable stuffing element with which the fabric web in rope form is batch-wise successively inserted into the crumple tube, compressed and finally forced out at the opposite end, and to a process for treating the fabric webs following the production of the crumple pleat creases.

Skirts and dresses made of pleated fabrics, i.e. fabrics having a permanently set crease pattern, are an established part of Ladies' fashion. Hitherto, the pleating produced in fabric webs by machine has predominantly taken the form of the so-called machine pleat, where a pleating machine having so-called pleating blades is used to produce parallel pleats of equal width extending across the fabric web and these pleats are permanently set by heating in a calendar having at least one heated roll. In individual fabric cuts, for example skirt cuts for wide Ladies' skirts expanding into a bell shape, pleat patterns were also produced in the form of the sunray pleat and—recently—also in the form of the so-called artistic pleat by placing the cuts by hand between stiff cardboard pleating moulds prefolded in accordance with the pleat pattern and subsequently clamped together, which are then permanently set in so-called steaming cabinets or autoclaves by the action of superheated steam and subsequent drying.

In addition to the production of regular pleats in fabric webs, it is also known to continuously produce so-called crinkle pleats in fabric webs (DE-A-3,145,404) by forming the originally smooth fabric web into a tube-shaped rope and then pulling the rope, with reduction in diameter, through an elongated tubular die of relatively small diameter in which superheated steam is simultaneously applied to the fabric web rope. After passing through the die the fabric web rope is opened out, pulled apart and dried, setting the crinkle pleat pattern produced in the die. Crinkle pleat patterns produced in this way have irregularly wide and long pleats which, however, are predominantly oriented in the longitudinal direction of the fabric web. Finally, there are also already in existence devices for producing crumple pleat patterns in fabric webs (U.S. Pat. No. 3,987,519; DE-A-2,932,495) where the fabric web—instead of being pulled through a crinkling die—is stuffed into a crumple tube and compressed, and the resulting creases are set by the action of superheated steam and subsequent drying. The crumple pleat pattern produced in this way differs from the aforementioned crinkle pleat pattern in that the pleats produced do not have any predominant direction of orientation but are completely irregular. In the known devices, the element stuffing the fabric web rope into the crumple tube is either an oscillatingly driven ring which is provided with wire brushes having wire bristles inclined away from the stuffing direction and which cooperates with corresponding wire brushes at the entry side end of the crumple tube (U.S. Pat. No. 3,987,519) or is a likewise oscillatingly traversing stuffer ring where the escape of the fabric web out of the crumple tube during the return stroke of the stuffer ring is prevented by clamping jaws then contacting the fabric web rope (DE-A-2,932,495).

However, the feeding of the fabric web rope into the crumple tube by means of wire brushes has to be ruled out in the case of thin and sensitive, fine-thread fabrics which can be perforated by the wire bristles and possible even damaged. On the other hand, the need to synchronize the drive of the clamping jaws with the stroke of the stuffer ring represents a complication of the device. In both cases, the compacting of the fabric web rope in the crumple tube and thus also the sharpness of the resulting crumple creases depends on the friction between the inner surface of the crumple pipe and the fabric web plug. It is thus the case that the sharpness of the pleat pattern varies with variation in the friction between the fabric web plug and the crumple tube as a consequence of different fabric web materials without any influencing being possible.

Against that, the invention has for its object to provide a high-performance device for producing permanently set crumple pleat patterns in fabric webs, which makes it possible to process a very wide range of fabrics without any danger of damage through the stuffing process or—in particular in the case of thicker fabrics—indistinct patterns.

SUMMARY OF THE INVENTION

On the basis of a device of the type mentioned at the beginning, this object is achieved according to the invention when there is provided upstream of the entry end of the crumple tube a rope feed tube which has a smaller diameter than the crumple tube and which also has a straight-lined end section which is approximately centrally aligned with the crumple tube and which, via a curvilinear transition section, turns into a feed-in section which is inclined towards the end section, when the stuffer element is a ram which enters the end section through an opening in the wall of the curvilinear transition section, and when the end section of the rope feed tube has at least one, preferably more, through-hole(s) which is or are connected on the outside to a vacuum source. On retraction of the cam the fabric web rope is thus prevented from being pulled out by the suction effect of the vacuum applid at the through-holes, it being possible, by reducing the vacuum, to rule out any damage with 100% certainty even in the case of very delicate fabrics.

The connection of the through-hole(s) to the vacuum source is preferably effected by surrounding the end section of the rope feed pipe in the area provided with the through-hole(s) with a substantially sealed chamber which in turn is connectable to the vacuum source via an appropriate line.

The gap existing between the outer surface of the rope feed tube and the inner surface of the entry side end of the crumple tube is preferably tightly sealed by an annular wall which, on the one hand, centers the rope feed tube within the crumple tube and, on the other hand, prevents the ingress of ambient air into the crumple tube and the egress of any steam introduced into the crumple tube.

In an advantageous development of the invention, the exit side end of the crumple tube is sealable by a pivotably jointed lid which is springingly pretensioned in the position sealing the exit side end of the crumple tube, the pretension of the spring element forcing the lid into the sealign position preferably being variable to be able to set the opening resistance with which the lid opposes the exiting of the part of the fabric web rope which is situated in a compressed state in the crumple tube during the continuous stuffing in of further untreated fabric web material, as a function of the particular material to be treated and/or as a function of the sharpness of the crumple pieces to be produced.

It is of advantage here for the spring element which pretensions the lid into the sealing position to be a gas spring element whose spring force is variable in the desired manner by applying compressed air or venting.

In a preferred embodiment of the invention, the device has at least one superheated steam inlet which ends in a conventional manner in the interior of the crumple tube and is connectable to a superheated steam source.

This superheated steam inlet can be formed by one or more through-hole(s) in the annular wall sealing the gap between the rope feed tube and the crumple tube, the through-hole(s) then each being connected to a line connectable to a superheated steam source.

Alternatively, the superheated steam inlet can also be formed by one or more through-hole(s) in the wall of the crumple tube itself.

To heat the crumple tube, electrical resistance heating elements can be arranged on its outer surface, a preferably adjustable thermostat switch which senses the wall temperature of the crumple tube being expediently connected into the electrical supply line to the resistance heating elements to avoid overheating.

Alternatively, it is also possible for a coiled pipe through which a liquid, gaseous or vapourous form heating medium can flow to be arranged on the outer surface of the crumple tube to transfer the heat supplied by the heating medium to the wall of the crumple tube.

A further way of heating the crumple tube consists in that, for at least a part of its longitudinal extension, the crumple tube is concentricaly surrounded by a jacket tube whose clear internal diameter is greater than the outer diameter of the crumple tube, the annular gaps existing at the front ends between the outer surface of the crumple tube and the inner surface of the jacket tube being tightly sealed by annular walls to form in this way, between the crumple tube and the jacket tube, a heating chamber which has an inlet and an outlet for a liquid, gaseous or vaporous heating medium.

If the crumple tube is heated with superheated steam which, in addition, is also to be made to act on the fabric web material, the outlet can also be formed by one or more through-hole(s) in the part of the crumple tube which is surrounded by the jacket tube. The superheated steam initially introduced for heating the crumple tube then leaves into the interior of the crumple tube.

If the crumple tube is heated with superheated steam under superatmospheric pressure and the fabric web material is subsequently treated with the superheated steam in the manner indicated above, it is advisable to place upstream of the through-hole(s) a throttling device in which the superheated steam introduced under superatmospheric pressure into the heating chamber is let down before flowing into the interior of the crumple tube. In this way, it is possible to maintain the superatmospheric pressure of the superheated steam in the heating chamber and thus also its temperature in the heating chamber above 100° C.

In this arrangement, there is expediently connected in between the through-hole(s) and the throttling device in the heating chamber a coiled pipe through the walls of which the steam let down in the throttling device and flowing towards the through-hole is reheated by the superheated steam introduced under superatmospheric pressure into the heating chamber. This reheatig serves to reconvert the water which has condensed out of the steam in the course of the throttling process back into the vapour form, thereby avoiding discolorations or spots which could result on delicate fabrics through the action of water of condensation.

BRIEF DESCRIPTION OF THE DRAWING

In what follows, the invention is described in more detail by means of two illustrative embodiments in conjunction with a drawing, where.

DETAILED DESCRIPTION OF THE PREFERRED EMBODIMENT

Figure 1:
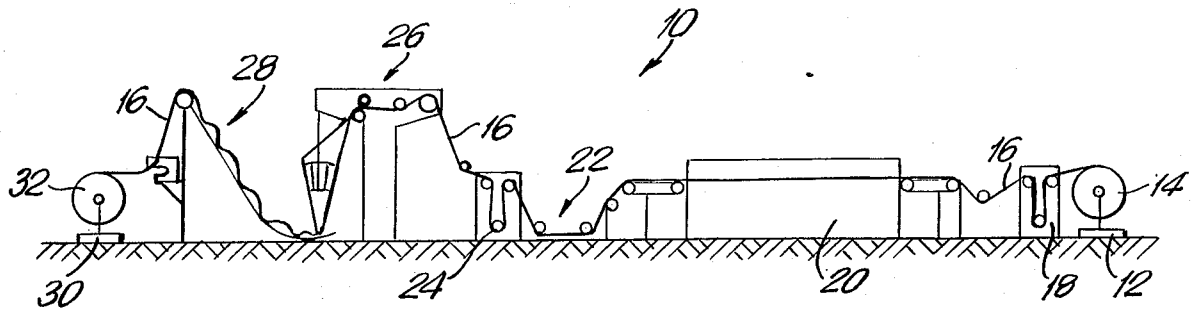
FIG. 1 shows a schematic side view of a range for continuously producing permanently set crumple pleat patterns in originally smooth fabric webs.

The range shown in FIG. 1 and denoted as a whole by 10 has at its right end a frame 12 for rotatably supporting a smooth fabric web 16 rolled up as roll 14. The fabric web 16 is taken off by a frame 18, arranged adjacent to frame 12, using mechanically driven rollers and then supplied to the crumple station 20 which forms the subject-matter of the invention and in which, first, the fabric web 16 is gathered together to form a rope, and the rope is then compressed in the transport direction and preferably heated by superheated steam passing through, as a result of which the irregular pleats formed during the compressing are formed with sharp edges. After leaving the crumple station 20, the still hot and possibly somewhat moist crumpled fabric web rope 16 is cuttled into an intermediate store 22 to allow the rope 16 to cool down somewhat and to evaporate the moisture. By means of a further frame 24 having mechanically driven rolls, the crumpled fabric web, which is still in rope form, is pulled out of the intermediate store 22 and supplied to an unfolding station 26 which is depicted only schematically and in which the rope is opened out and unfolded in the transverse direction without thereby completely eliminating the crease lines of the pleats produced in the course of the crumple treatment. Hot air is blown onto the unfolded fabric web 16 to dry it completely, and it then passes through a cooling leg 28 before—now bearing an irregular pattern of crumple pleats—it is wound up on a frame 30 into a roll 32.

Figure 2:
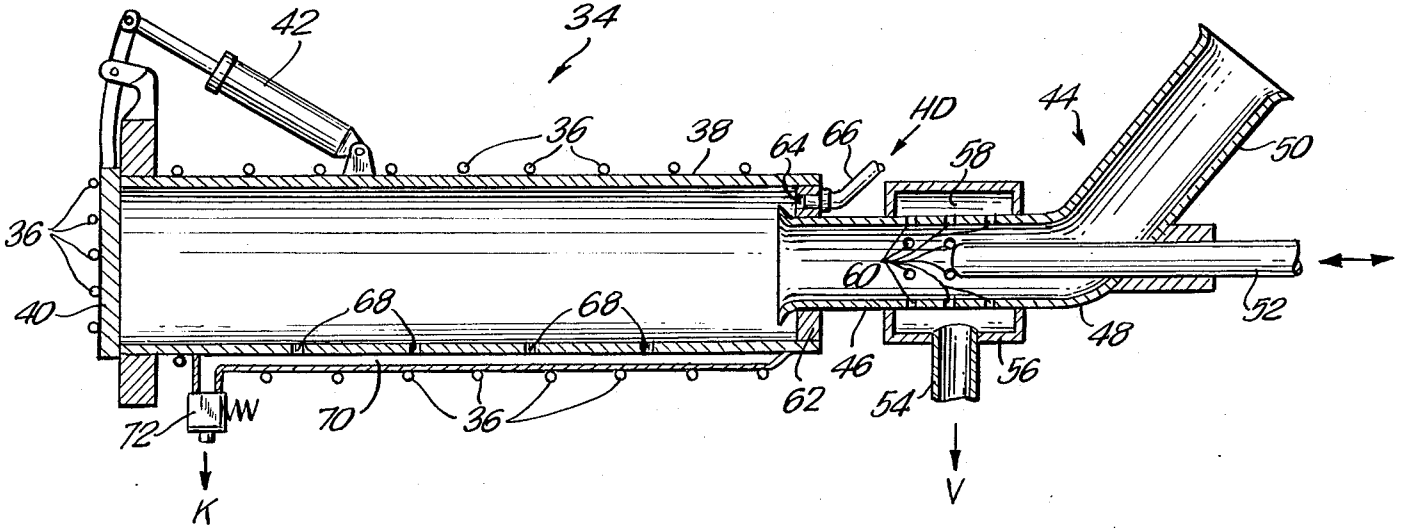
FIG. 2 shows a longitudinal central section through a first illustrative embodiment of a device which represents the actual crumple station of the range shown in FIG. 1.

An illustrative embodiment of the inner structure of the device 34 in the crumple station 20 which performs the actual crumpling operation, i.e. the compressing of the fabric web previously gathered into rope form and the heat and optional steam treatment, is depicted in FIG. 2. The device 34 has an elongated cylindrical crumple tube 38 which is heatable on its outer surface by a winding of electrical resistance heating elements 36 and which is expediently made of stainless steel. To the left-hand exit side end of the crumple tube 38, there is pivotably jointed a likewise heatable metallic lid 40 in such a way as to be pivotable upward, from the closed position shown, into a position which clears the exit from the crumple tube 38. By means of a spring, which in the case depicted is shown as a gas spring element 42, the lid 40 is pressed against the crumple tube end with a certain pretension which is variable by changing the gas pressure in the spring element 42.

On the entry side, there is connected upstream of the crumple tube 38 a rope feed tube 44 which has a straight-lined end section 46 which is introduced approximately centrally aligned into the inlet side end of the crumple tube 38 and maintained therein and which turns via a curvilinear transition section 48 into an intake section 50 aligned at an angle to the end section 46. Its front end guided longitudinally slideable through an opening in the wall of the transition section 48, a ram 52 enters the end section 46 approximately centrally and is oscillatingly driveable, for example by a drive device (not depicted), formed for example by a pneumatic piston-cylinder unit. The end section 46 is surrounded over a part of its length by a housing 56 which is sealed off on all sides except for a connecting port 54 and which thus forms on the outer surface of the end section 46 a chamber 58 which is connectable to a vacuum source via the connecting port 54. Within the housing 56, there are provided in the end section 46 of the rope feed tube 44 a plurality of through-holes 60 via which the vacuum produced in the chamber 58 acts on the fabric web rope situated in the rope feed tube 44. This vacuum attracts the fabric web rope to the inner surface of the end section 46, allowing the oscillating ram 52 to be retracted from the end section 46 without at the same time pulling back the fabric web rope. However, when the ram 52 slides forward, the vacuum is not sufficient, and the fabric web rope entering via the intake section 50 is inevitably pushed forward into the interior of the crumple tube 38 and is compressed and compacted therein.

The annular gap existing between the outer surface of the end of the feed tube end section 46 which enters the crumple tube 38 and the inner surface of the crumple tube 38 is sealed off by a welded-in annular wall 62. A through-hole 64 in this annular wall 62 is the end of a pressure line 66 via which the superheated steam HD under superatmospheric pressure is supplied from a superheated steam source and can be blown into the interior of the crumple tube 38. To prevent the superheated steam blown into the crumple tube 38 from condensing in the crumple tube interior in the start-up state of the device or after the device has been taken out of operation and then possibly leading to spotting on a fabric web processed, there are provided, along the deepest shell line of the crumple tube 38, a number of holes 68 which end in an outer condensate discharge duct 70 from which the condensate can be discharged via a condensate valve 72. In this connection, it should be pointed out that during the operation of the device 34, the heating of the crumple tube 38 makes condensate formation unlikely.

Instead of the electrical heating described using resistance heating elements controlled via an adjustable thermostat switch, the crumple tube can also be heated by means of liquid, gaseous or vaporous heating media. The resistance heating elements 36 should then be thought of as replaced by a coiled pipe which is arranged on the outer surface of the crumple tube 38 and which is perfused by hot heat transfer oil, hot air or superheated steam.

Figure 3:
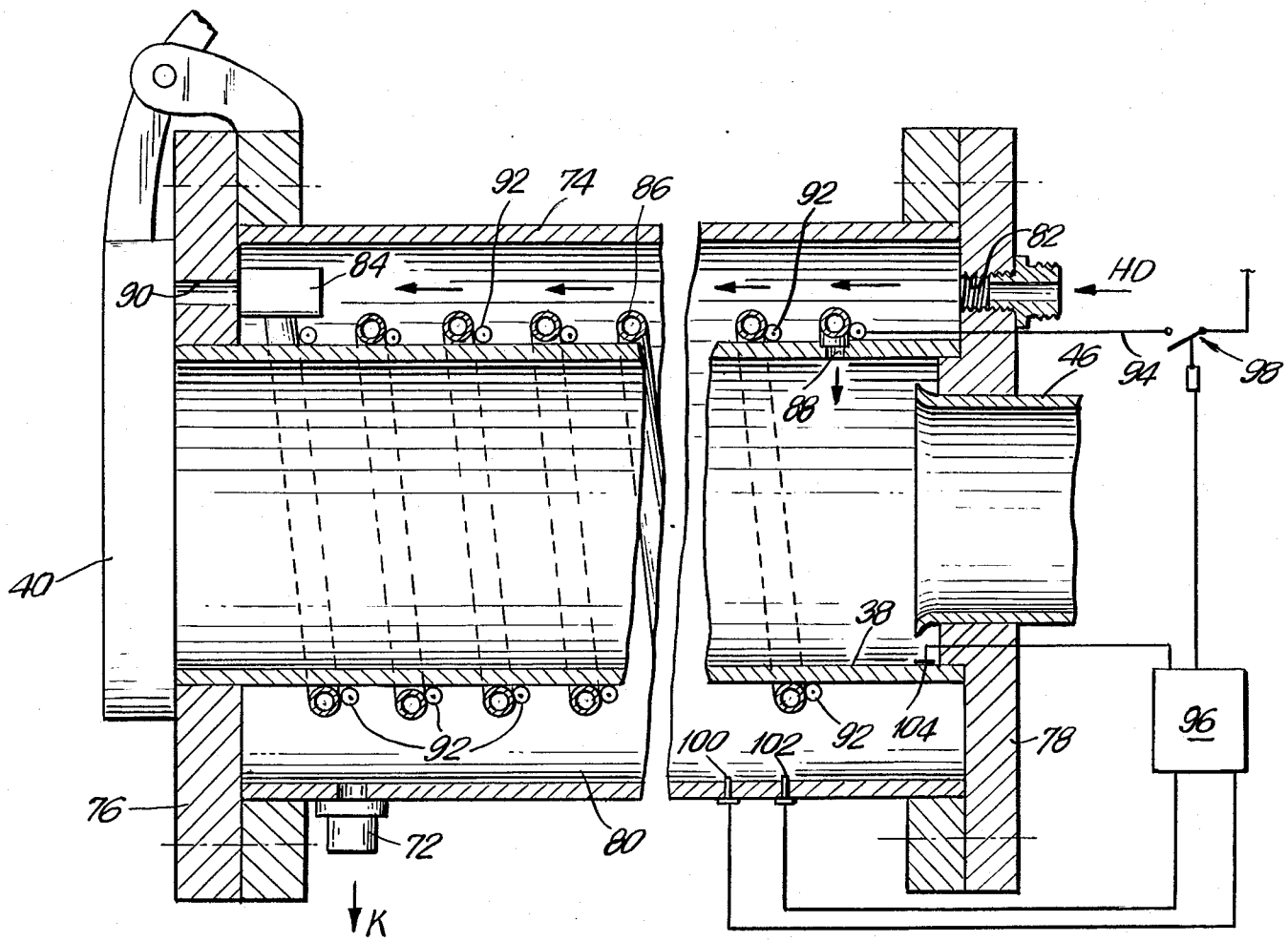
FIG. 3 shows a longitudinal central section through a second illustrative embodiment of the device forming the crumple station.

FIG. 3 shows an illustrative embodiment in which the heating of the crumple pipe tube 38 is effected by means of superheated steam HD which then also serves to treat the fabric web rope stuffed into the crumple tube 38. For this purpose, the crumple pipe tube 38 is concentrically surrounded by a jacket tube 74 whose clear internal diameter is greater than the outer diameter of the crumple tube 38. The annular gaps existing at the front side ends between the outer surface of the crumple tube 38 and inner surface of the jacket tube 74 are tightly sealed by annular walls or flanges 76, 78, thereby forming between the crumple tube 38 and the jacket tube 74 a heating chamber 80 via which a hole 82 in the flange 78 is chargeable with superheated steam HD. The superheated steam entering the heating chamber 80, for example at a temperature of 160° C and under a pressure of 6 bar, flows through the heating chamber and then into the inlet of a throttle valve 84 provided on the inner surface of the flange 76 within the heating chamber 80, the outlet of the throttle valve 84 being connected to a pipe 86 coiled in a plurality of windings around the crumple tube 38, the other end of the coiled pipe 86 ending in a through-hole 88 in the wall of the crumple tube. The throttling action of the throttle valve 84 is adjustable from the outside through a hole 90 in the flange 76, so that in this way the vapour pressure prevailing in the heating chamber 80 and thus also the temperatures of the steam in the heating chamber 80 are affectable via the setting of the throttle valve 84. By contrast, the pressure in the steam flowing through the coiled pipe 86 after exit from the throttle valve 84 is already substantially let down, so that the temperature of the steam decreases and the relative moisture content of the steam increases.

However, owing to the reheating effect of the steam in the course of flowing through the coiled pipe 86 the production of condensate during the operation of the device is prevented.

In order to be able to control the temperature within the heating chamber 80 independently of the steam supplied by the source of steam, immediately adjacent the coiled pipe 86 there are arranged a number of coils of a long strip-like or wire electric resistance heating element 92 on the crumple pipe tube 38. The resistance heating element can be connected via an electric connection 94 to an electric alternating current power supply while a switch 98 actuated by a control circuit 96 accomplishes switching on and off of heating element 92.

The temperature and the pressure of the steam flowing into the heating chamber is monitored respectively by at least one temperature sensor 100 and at least one pressure sensor 102. Temperature and pressure proportional signals are compared in control circuit 96 with characteristic curves of optimum temperature and pressure values. From the occurrence of impermissible deviations, the control circuit produces an actuating signal for the switch 98 which is thereby closed and activates the resistance heating element 92. Part of the supplemental heat is radiated directly to the surrounding steam thus increasig the temperature thereof and lowering its relative humidity. Another part of the heat created is transferred to the adjacent windings of the coiled pipe 86 and the crumple pipe tu be 38 so that it counteracts condensaton of the steam flowing through the windings and entering via the through-holes 88 into the crumple pipe tube 38. It may also be appropriate to provide a temperature sensor 104 which directly monitors the temperature of the crumple pipe tube 38. Sensor 104 closes the switch 98 when the temperature of the crumple pipe tube falls below a predetermined minimal value.

I claim:

1. A device for producing permanently set crumple pleat crease patterns in fabric webs, comprising: a heatable crumple tube having an entry end provided with an oscillatingly driveable stuffing element with which a fabric web in rope form is batchwise successively inserted into the crumple tube, compressed and finally forced out at an exit end, upstream of the entry end of the crumple tube a rope feed tube which has a smaller diameter than the crumpletube and which also has a straight-lined end section which is approximately centrally aligned with the crumple tube and which, via a curvilinear transition section, turns into a feed-in section which is inclined towards the end section, said stuffer element being a ram which enters the entry end section through an opening in the wall of the curvilinear transition section, the end section of the rope feed tube having at least one through-hole connected on the outside to a vacuum source, said crumple tube being concentrically surrounded over at least a part of its longitudinal extension by jacket tube having a clear internal diameter greater than the outer diameter of the crumple tube, annular gaps existing at front side ends between an outer surface of the crumple tube and an inner surface of the jacket tube being tightly sealed by annular walls, thereby forming between the crumple tube and the jacket tube a heating chamber which has inlet and outlet means for a fluid heating medium, at least one electric resistance heating element arranged within the heating chamber, at least one temperature and pressure sensor each in the heating chamber for determining the temperature and pressure respectively of the fluid fed into the heating chamber, a sensor for monitoring the temperature of the crumple tube, and a control circuit for continuously processing temperature and pressure proportional signals developed by the sensors for controlling connection and interruption between an electric power supply and said at least one resistance heating element.

2. A device according to claim 1, wherein the end section of the rope feed tube is surrounded in the area provided with the at least one through-hole by a substantially sealed chamber which is connected to said vacuum source.

3. A device according to claim 1, wherein the gap between the outer surface of the rope feed tube and the inner surface of the entry end of the crumple tube is tightly sealed by an annular wall.

4. A device according to claimm 3, wherein the inlet means comprises at least one inlet for superheated steam, which is connectable to a superheated steam source and ends in the interior of the crumple tube.

5. A device according to claim 4, wherein the inlet means is formed by at least one through-hole in the wall of the crumple tube itself.

6. A device according to claim 3, wherein the inlet means is formed by at least one through-hole in the annular wall sealing the gap between the rope feed tube and the crumple tube, said at least one through-hole being connected to a line connectable to a superheated steam source.

7. A device according to claim 1, wherein the exit end of the crumple tube is sealable by a pivotably jointed lid which is springingly pretensioned by a spring element into a position sealing the exit end of the crumple tube.

8. A device according to claim 7, wherein the pretension of the spring element forcing the lid into sealing position is variable.

9. A device according to claim 7, wherein the spring element is a gas spring element.

10. A device according to claim 7, wherein the lid is constructed to be heatable.

11. A device according to claim 1, wherein the at least one electrical resistance heating element is arranged on an outer surface of the crumple tube.

12. A device according to claim 11, comprising a thermostat switch for sensing the wall temperature of the crumple tube, connected to the at least one resistance heating element.

13. A device according to claim 1, wherein on the outer surface of the crumple tube there is arranged a coiled pipe perfusable with a fluid heating medium and connected to said inlet and outlet means.

14. A device according to claim 1, wherein the outlet means for the heating medium is formed by at least one hole in a part of the crumple tube which is surrounded by the jacket tube.

15. A device accordign to claim 14, for heating with superheated steam under superatmospheric pressure, wherein upstream of said at least one hole there is connected a throttle device in which superheated steam introduced after superatmospheric pressure into the heating chamber is let down before flowing on into the interior of the crumple tube.

16. A device according to claim 15, wherein between said at least one hole and the throttle device in the heating chamber there is connected a coiled pipe through walls of which the steam let down in the throttle device and flowing towards the at least one hole is reheated by the superheated steam introduced under superatmospheric pressure into the heating chamber.

17. A device according to claim 1, wherein said at least one resistance heating element is arranged in a plurality of spiral windings on the outside of the crumple tube.

18. A device for producing permanently set crumple pleat crease patterns in fabric webs, comprising: a heatable crumple tube having an entry end provided with an oscillatingly driveable stuffing element with which a fabric web in rope form is batchwise successively inserted into the crumple tube, compressed and finally forced out at an exit end, upstream of the entry end of the crumple tube a rope feed which has a smaller diameter than the crumple tube and which also has a straight-lined end section which is approximately centrally aligned with the crumple tube and which, via a curvilinear transition section, turns into a feed-in section which is inclined towards the end section, said stuffer element being a ram which enters the entry end section through an opening in the wall of the curvilinear transition section, the end section of the rope feed tube having at least one through-hole connected on the outside to a vacuum source, said crumple tube being concentrically surrounded over at least a part of its longitudinal extension by a jacket tube having a clear internal diameter greater than the outer diameter of the crumple tube, annular gaps existing at front side ends between an outer surface of the crumple tube and an inner surface of the jacket tube being tightly sealed by annular walls, thereby forming between the crumple tube and the jacket tube a heating chamber which has inlet and outlet means for a fluid heating medium, at least one electric resistance heating element arranged within the heating chamber, at least one temperature and pressure sensor each in the heating chamber for determining the temperature and pressure respectively of the fluid fed into the heating chamber, and a control circuit for continuously processing temperature and pressure proportional signals developed by the sensors for controlling connection and interruption between an electric power supply and said at least one resistance heating element.

* * * * *